US011412872B2

(12) United States Patent
Lai

(10) Patent No.: US 11,412,872 B2
(45) Date of Patent: Aug. 16, 2022

(54) REINFORCED STRUCTURE OF COMPOSITE CHOPSTICKS

(71) Applicant: Layana Co., Ltd., Changhua County (TW)

(72) Inventor: Yin-Chu Lai, Changhua County (TW)

(73) Assignee: Layana Co., Ltd.

( * ) Notice: Subject to any disclaimer, the term of this patent is extended or adjusted under 35 U.S.C. 154(b) by 0 days.

(21) Appl. No.: 17/183,175

(22) Filed: Feb. 23, 2021

(65) Prior Publication Data

US 2021/0259444 A1 Aug. 26, 2021

(30) Foreign Application Priority Data

Feb. 24, 2020 (TW) ..... 109105893

(51) Int. Cl.
*A47G 21/06* (2006.01)

(52) U.S. Cl.
CPC ..... *A47G 21/103* (2013.01)

(58) Field of Classification Search
CPC ..... A47G 21/103; A47G 2021/002; A47G 2400/10; A47L 17/10; B28B 1/14; B28B 7/42
See application file for complete search history.

(56) References Cited

U.S. PATENT DOCUMENTS 6,328,360 B1 * 12/2001 Freeman ..... A47G 21/103 206/553
6,607,225 B1 * 8/2003 Lai ..... A47G 21/103 294/218
2009/0121501 A1 * 5/2009 Liu ..... A47G 21/10 294/99.2
2017/0049255 A1 * 2/2017 Chen ..... A47G 21/103

FOREIGN PATENT DOCUMENTS

CN 107440443 A * 12/2017
CN 107440443 A 12/2017
CN 107440444 A * 12/2017
(Continued)

OTHER PUBLICATIONS

Communication corresponding to Taiwan Application No. 109105893 and issued by Taiwan Intellectual Property Office dated Oct. 23, 2020, 3 pages.

*Primary Examiner* — Dean J Kramer
(74) *Attorney, Agent, or Firm* — Innovation Counsel LLP

(57) ABSTRACT

The reinforced structure of the composite chopsticks of the present invention is fixed in a gripping portion and a clamping portion, and mainly comprises a first tubular member, a filling portion and a second tubular member. The first tubular member is positioned in the clamping portion and has at least one first open slot; the filling portion fills in the interior of the clamping portion and the first open slot to fix the first tubular member; and the second tubular member is fixed in the interior of the gripping portion and is formed by extending one end of the first tubular member. In this way, the reinforced structure can be effectively positioned during the molding process, and the bonding force between the heterogeneous materials can be increased to enhance the strength of the clamping portion, so as to improve the product quality and to prolong the service life.

8 Claims, 2 Drawing Sheets

(56) References Cited

FOREIGN PATENT DOCUMENTS

| | | | | |
|---|---|---|---|---|
| KR | 20-0190561 | Y1 | | 8/2000 |
| KR | 200190561 | Y1 | * | 8/2000 |
| TW | M397216 | U1 | | 2/2011 |
| TW | M458170 | U1 | | 8/2013 |
| TW | M489587 | U | | 11/2014 |
| TW | M493943 | U | | 1/2015 |

* cited by examiner

REINFORCED STRUCTURE OF COMPOSITE CHOPSTICKS

This application claims the benefit of Taiwan application Serial No. 109105893, filed Feb. 24, 2020, the disclosure of which is incorporated by reference herein in its entirety.

BACKGROUND

Technical Field

The disclosure relates in general to a reinforced structure of composite chopsticks, and more particularly to a reinforced structure of composite chopsticks capable of effectively increasing the strength to improve its product quality and prolong its service life.

Description of the Related Art

The chopsticks that people often use in the past are mainly made of wood, however, the wooden chopsticks are prone to grow mildew when they are in a moisture state, and they are easy to have disgusting dirt due to scratches after long-term use, therefore, the chopsticks used currently in the market are mostly made by metal processing, especially hollow stainless steel chopsticks are frequently used.

The above-mentioned hollow stainless steel chopsticks are mainly made of stainless steel plates that are wound into a circular tube and then formed by welding and grinding process. As shown in Taiwan Patent Publication No. M493943, entitled "Improvement of Hollow Metal Chopsticks Structure", which discloses the chopsticks are formed by bending metal plate and welding method or formed by directly pressure method. The hollow stainless steel chopsticks are made into a round tube or a square tube. However, the interior of the above-mentioned metal chopsticks is completely hollow. In actual use, it is easy to form dents or depressions on the metal surface due to slight external force, even after being subjected to a large external force. As a result, it will not only reduce the quality of the product due to dents or depressions, and is not conducive to the user to grip the food, but also reduce the service life of the product.

For example, as shown in Taiwan Patent Publication No. M458170, entitled "Composite Chopsticks Reinforcement Structure" and applied by the applicant of the present application, which discloses a structure in which a reinforced rod is wrapped in a metal sleeve and a plastic gripping body. The chopsticks are reinforced by the reinforced rod to prevent the formation of dents or depressions on the surface of the metal sleeve, and effectively improve the bending strength.

SUMMARY

However, in the injection molding process of the composite chopsticks of the above-mentioned patent No. M458170, the reinforced rod needs to be suspended and positioned between the inside and outside of the open end of the metal sleeve, and then at the same time when the plastic gripping body is molded, the reinforced rod is covered, and the quality of the product is easily affected by the deviation of the reinforced rod during the molding process. Furthermore, since the outer periphery of the reinforced rod and the inner periphery of the metal sleeve are filled with plastic material, the connection of the heterogeneous material between each other of the metal sleeve, the plastic material and the rod material often has insufficient overall strength and bonding force, and the expected strength reinforcement effect cannot be achieved. In view of this, in order to provide a structure that is different from the conventional technology and improve the above-mentioned shortcomings, the inventor of the present application has accumulated experience and continuous research and development of many years, and thus the present invention is provided.

One aspect of the present invention is to provide a reinforced structure of composite chopsticks, so as to solve the problem that the conventional solid reinforced rod cannot be effectively positioned during molding, and cannot produce the expected strength and bonding force in connection of the heterogeneous material and will has problems of insufficient strength, easy to form dents, depressions or bending on the surface. The present invention can localize a reinforced structure and improve the bonding force between heterogeneous materials to increase the whole strength and the surface strength of the metal chopsticks, thereby improving its product quality and extending its service life.

In order to achieve the above-mentioned purpose, the reinforced structure of the composite chopsticks provided in the present invention includes a first tubular member, a filling portion and a second tubular member. The first tubular member is positioned in the clamping portion, the first tubular member has at least one first open slot; the filling portion fills in the interior of the clamping portion and the at least one first open slot to fix the first tubular member; and the second tubular member is fixed in the interior of the gripping portion, and the second tubular member is formed by extending one end of the first tubular member.

In one embodiment, the outer periphery of the first tubular member and the inner periphery of the clamping portion have the same cross-section, and the outer periphery of the first tubular member is smaller than the inner periphery of the clamping portion, so that the first tubular member is directly inserted and positioned in the clamping portion.

In one embodiment, the first open slot is arranged coaxially with the first tubular member, so that the first tubular member has the flexibility of expansion and contraction in the radial direction.

In one embodiment, at least one radial perforation is further provided on the tube wall of the second tubular member.

In one embodiment, the second tubular member further has a second open slot, and the second open slot is arranged coaxially with the second tubular member, so that the cross-section of the second tubular member is C-shaped.

In one embodiment, one end of the filling portion fills in the inner periphery and outer periphery of the second tubular member.

In one embodiment, one end of the filling portion is extended from one end of the clamping portion to form a gripping portion.

In one embodiment, the present invention further includes a necking section, one end of the necking section extends to form the first tubular member, and the other end of the necking section extends to form the second tubular member.

In one embodiment, the first tubular member has a first pipe with two open ends, the necking section has an intermediate pipe, and the second tubular member has a second pipe with two open ends, the first pipe, the intermediate pipe, and the second pipe are connected in a straight line in sequence.

Other objects, features, and advantages of the invention will become apparent from the following detailed description of the preferred but non-limiting embodiments. The following description is made with reference to the accompanying drawings.

Figure 1:
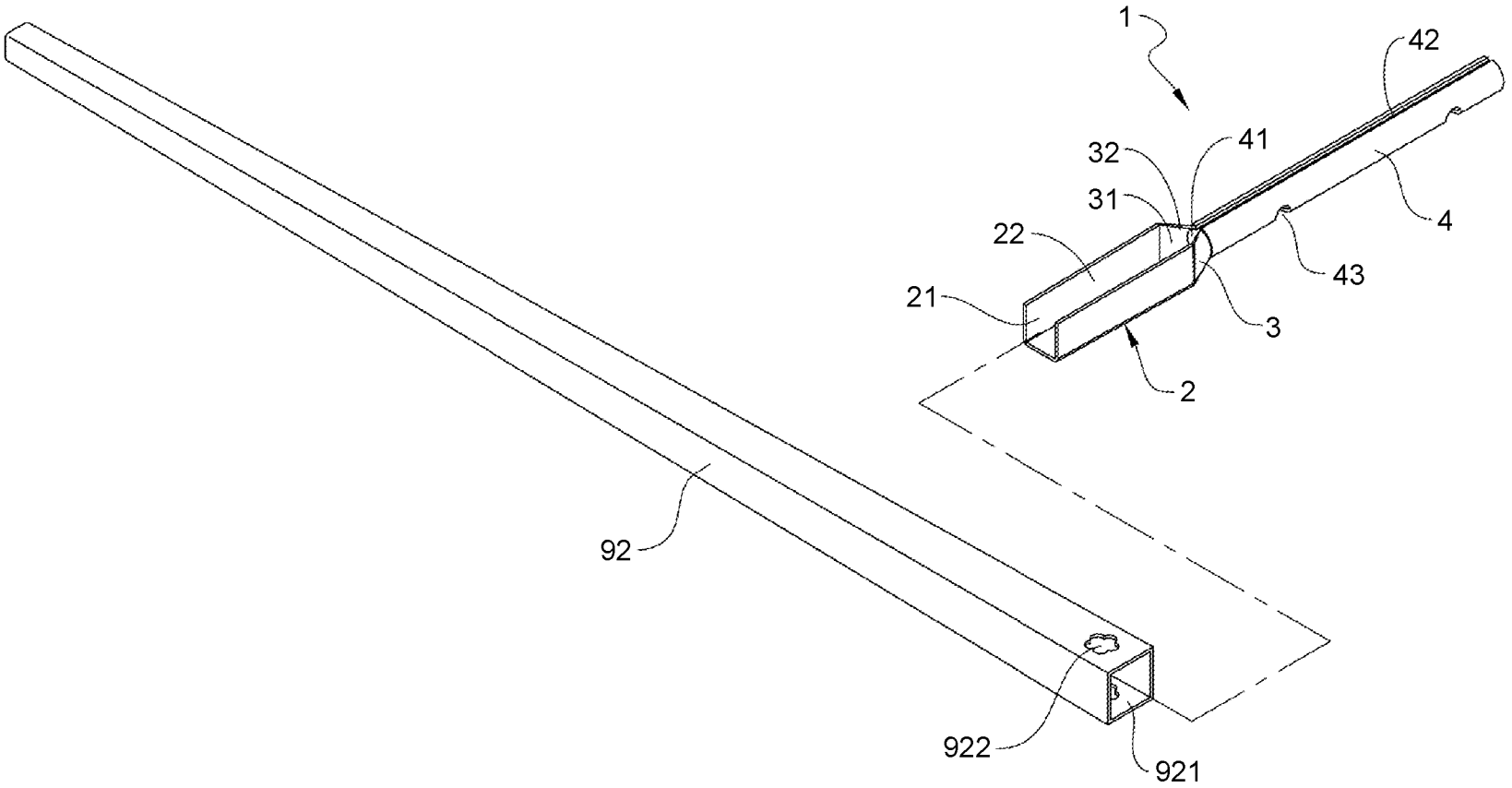
FIG. 1 is a perspective view of components in part according to a preferred embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

DETAILED DESCRIPTION

The reinforced structure of the composite chopsticks of the present invention is fixed in a clamping portion and a gripping portion, and mainly includes a first tubular member and a second tubular member extending in sequence. The first tubular member and the second tubular member are respectively positioned inside the clamping portion and the gripping portion, and the first tubular member has at least one first open slot; and a filling portion fills in the interior of the clamping portion and the at least one first open slot, so that the first tubular member is fixed in the clamping portion.

Figure 2:
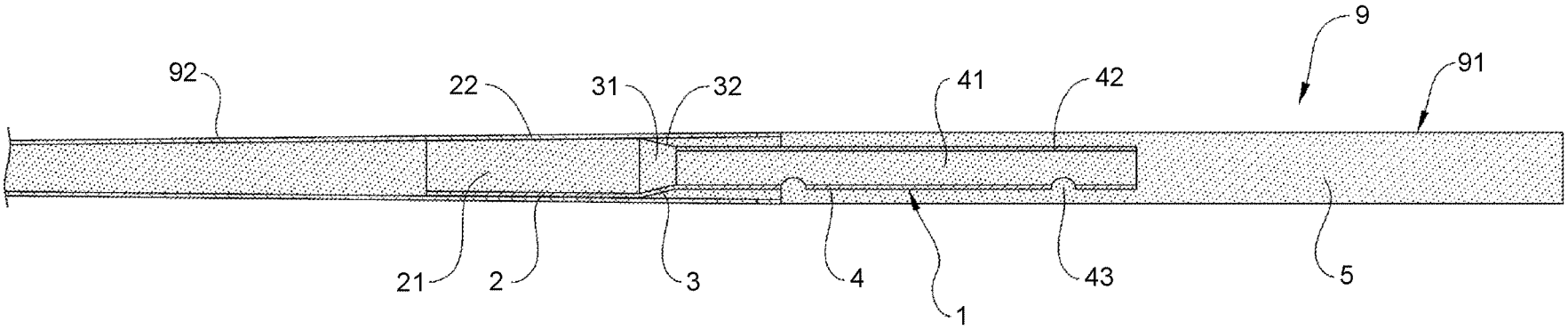
FIG. 2 is a combined cross-sectional view according to a preferred embodiment of the present invention.

Please refer to FIGS. 1 and 2, a reinforced structure 1 of the composite chopsticks according to a preferred embodiment of the present invention is provided. The composite chopsticks 9 mainly include a gripping portion 91 that can be held by the user and a clamping portion 92 for holding food. The bottom end of the gripping portion 91 is connected to the top end of the clamping portion 92, and the clamping portion 92 is a tapered hollow metal rod of square shape; in one embodiment, the clamping portion 92 can also be a tapered tube of circular shape, or other polygonal tapered tube whose cross-section is elliptical, triangular, or quadrilateral. An opening 921 is formed at the top end of the clamping portion 92, and opposite sides of the upper half of the clamping portion 92 are respectively provided with a through hole 922 transversely penetrating the tube wall thereof.

The reinforced structure 1 of the composite chopsticks 9 includes a first tubular member 2, a necking section 3, a second tubular member 4, and a filling portion 5. The first tubular member 2, the necking section 3 and the second tubular member 4 are formed by bending a metal plate, respectively. After forming, the cross-section of the first tubular member 2 is square, and forms the first pipe 21 with two open ends; the outer periphery of the first tubular member 2 is smaller than the inner periphery of the clamping portion 92 so that the first tubular member 2 is directly inserted and positioned in the clamping portion 92; at least one first open slot 22 is provided coaxially and spaced apart on the square tube wall of the first tubular member 2. In one embodiment, the first open slot 22 is preferably one side of a square tube, so that the first tubular member 2 has the flexibility of expansion and contraction in the radial direction. After being inserted into the square tapered pipe of the clamping portion 92, the first tubular member 2 is pressed tightly against the inner periphery of the clamping portion 92 by the outward force of expansion, and produces the effect of stabilizing and fixing the position.

The necking section 3 is a tapered tube, one end of the necking section 3 with a larger diameter extends to form the first tubular member 2, and the other end of the necking section 3 with a smaller diameter extends to form the second tubular member 4. A tapered intermediate pipe 31 is formed between the two diameters. One end of the intermediate pipe 31 is connected to the first pipe 21 of the first tubular member 2; the pipe wall of the necking section 3 is coaxially provided with a third open slot 32. The third open slot 32 communicates with the first open slot 22.

The second tubular member 4 is a straight pipe with a second pipe 41 that is open at both ends. The first pipe 21, the intermediate pipe 31 and the second pipe 41 are connected in a straight line in sequence; one side of the tube wall of the second tubular member 4 is coaxially provided with a second open slot 42 so that the cross-section of the second tubular member 4 is C-shaped, and the second open slot 42 is connected to the third open slot 32; the other side of the tube wall of the second tubular member 4 is provided with two radial through holes 43 coaxially arranged and spaced apart. In one embodiment, one radial through hole 43 may also be provided.

The filling portion 5 is molded by resin pouring, casting or injection. During molding, the plastic enters from the second tubular member 4 toward the direction of the first tubular member 2, and fills in the interior of the clamping portion 92, at least one first open slot 22 and the through hole 922 on the upper half side of the clamping portion 92, so that one end of the filling portion 5 and the first tubular member 2 are firmly fixed in the clamping portion 92. The other end of the filling portion 5 fills in the inner and outer peripheries of the second tubular member 4 to completely cover the second tubular member 4 so that the second tubular member 4 is fixed in the interior of the gripping portion 91. In this embodiment, when the filling portion 5 fills the interior of the clamping portion 92, the filling portion 5 would protrude outward in a straight line from the top opening 921 of the clamping portion 92, except for completely covering the second tubular member 4. In addition, another square gradually expanding extension rod is formed at the same time, and the extension rod is used as the gripping portion 91 to form a two-stage chopstick structure of different materials.

Therefore, the present invention has the following advantages:

1. The first tubular member of the present invention has the flexibility of expansion and contraction in the radial direction. After being inserted into the clamping portion, the first tubular member can rebound to stabilize the position. Therefore, when the plastic is injected, the entire supporting member can be held without offset or skewing, so that the plastic material can be filled in the inner and outer spaces of the predetermined first tubular member and the second tubular member, so as to ensure the technical quality of the embedded injection molding of the integrated chopsticks.

2. The outer periphery of the first tubular member of the present invention is directly pressed against the inner periphery of the clamping portion, and the first tubular member, the necking section and the second tubular member are respectively bent by a metal plate. Therefore, when the filling portion fills into the interior of the clamping portion, at least one first open slot and the through holes on the upper half of the clamping portion, it can not only effectively improve bending strength of the middle of the composite chopsticks combined with heterogeneous materials, make the composite chopsticks not easy to break, and can effectively increase the whole strength and surface strength of the metal rod, so as to improve the product quality and extend the service life of the chopsticks.

3. The tube wall of the first tubular member of the present invention is provided with at least one first open slot, and the tube wall of the second tubular member is coaxially provided with a second open slot on one side of the tube wall. The other side of the tube wall is provided with at least one radial perforation. Therefore, when the filling portion is molded, not only the plastic can flow smoothly to cover and fix the first tubular member, the necking section and the second tubular member, but also the connecting force between the gripping portion and the clamping portion can be enhanced to prevent separation.

In summary, according to the contents disclosed above, the present invention can clearly achieve the expected purpose, provide a reinforced structure that can effectively a reinforced structure, improve the bonding force between heterogeneous materials, and can effectively increase the whole strength and surface strength of the metal chopsticks, so as to improve product quality and prolong service life for industrial use. Thus, an invention application in accordance with the patent law is filed.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A reinforced structure of composite chopsticks, wherein the composite chopsticks comprise a gripping portion that is held by a user and a clamping portion, one end of the gripping portion is connected to an end of the clamping portion, and the clamping portion is a hollow metal rod with an opening formed at the end; the reinforced structure of the composite chopsticks comprising:

a first tubular member positioned in the clamping portion, the first tubular member having at least one first open slot;

a filling portion filling in an interior of the clamping portion and the at least one first open slot to fix the first tubular member; and a second tubular member fixed in an interior of the gripping portion, and the second tubular member is formed by extending one end of the first tubular member, wherein the filling portion is formed of plastic, fills an inner space of the second tubular member, and fills a space outside the second tubular member and inside the gripping portion.

2. The reinforced structure of composite chopsticks of claim 1, wherein an outer periphery of the first tubular member is smaller than an inner periphery of the clamping portion, so that the first tubular member is directly inserted and positioned in the clamping portion.

3. The reinforced structure of composite chopsticks of claim 1, wherein the first open slot is arranged coaxially with the first tubular member, so that the first tubular member has a flexibility of expansion and contraction in a radial direction.

4. The reinforced structure of the composite chopsticks of claim 1, wherein at least one radial through hole is further provided on a tube wall of the second tubular member.

5. The reinforced structure of composite chopsticks of claim 4, wherein the second tubular member further has a second open slot, and the second open slot is arranged coaxially with the second tubular member, so that a cross-section of the second tubular member is C-shaped.

6. The reinforced structure of composite chopsticks of claim 1, wherein one end of the filling portion is extended from one end of the clamping portion to form the gripping portion.

7. The reinforced structure of the composite chopsticks of claim 1, further comprising a necking section, one end of the necking section extends to form the first tubular member, and other end of the necking section extends to form the second tubular member.

8. The reinforced structure of composite chopsticks of claim 7, wherein the first tubular member has a first pipe with two open ends, the necking section has an intermediate pipe, and the second tubular member has a second pipe with two open ends, the first pipe, the intermediate pipe, and the second pipe are connected in a straight line in sequence.

* * * * *